US011508293B1

(12) United States Patent
Wu et al.

(10) Patent No.: US 11,508,293 B1
(45) Date of Patent: Nov. 22, 2022

(54) DISPLAY SYSTEM

(71) Applicant: Prilit Optronics, Inc., Tainan (TW)

(72) Inventors: Biing-Seng Wu, Tainan (TW); Tzung-Ren Wang, Tainan (TW)

(73) Assignee: Prilit Optronics, Inc., Tainan (TW)

( * ) Notice: Subject to any disclaimer, the term of this patent is extended or adjusted under 35 U.S.C. 154(b) by 0 days.

(21) Appl. No.: 17/495,412

(22) Filed: Oct. 6, 2021

(51) Int. Cl.
*G09G 3/32* (2016.01)

(52) U.S. Cl.
CPC ..... *G09G 3/32* (2013.01); *G09G 2310/0267* (2013.01); *G09G 2310/0275* (2013.01); *G09G 2310/08* (2013.01); *G09G 2320/064* (2013.01)

(58) Field of Classification Search
CPC ..... G09G 2310/0267; G09G 3/32; G09G 2310/0275; G09G 2310/08; G09G 2320/064
See application file for complete search history.

(56) References Cited

U.S. PATENT DOCUMENTS

2019/0347981 A1* 11/2019 Horowitz ..... H04N 9/3135
2020/0043405 A1* 2/2020 Akimoto ..... G09G 3/3233
2020/0312231 A1* 10/2020 Hussell ..... G09G 3/2096
2020/0365092 A1* 11/2020 Yoshida ..... G09G 3/3406

* cited by examiner

*Primary Examiner* — Muhammad N Edun
(74) *Attorney, Agent, or Firm* — Donald E. Stout; Stout, Uxa & Buyan, LLP

(57) ABSTRACT

A display system includes a display panel that includes a plurality of micro-light-emitting diodes (microLEDs), the display panel being divided into a plurality of display blocks; and a plurality of drivers correspondingly driving the plurality of display blocks. Data signals of each driver are provided to a corresponding display block at different times within a horizontal scan period.

11 Claims, 3 Drawing Sheets

DISPLAY SYSTEM

BACKGROUND OF THE INVENTION

1. Field of the Invention

The present invention generally relates to a display system, and more particularly to a micro-light-emitting diode (microLED) display system.

2. Description of Related Art

A micro-light-emitting diode (microLED, mLED or μ LED) display panel is one of flat display panels, and is composed of microscopic microLEDs each having a size of 1-100 micrometers. Compared to conventional liquid crystal display panels, the microLED display panels offer better contrast, response time and energy efficiency. Although both organic light-emitting diodes (OLEDs) and microLEDs possess good energy efficiency, the microLEDs, based on group III/V (e.g., GaN) LED technology, offer higher brightness, higher luminous efficacy and longer lifespan than the OLEDs.

Conventional microLED display systems may adopt a pulse-width modulation (PWM) scheme, which generates a PWM signal, a duty cycle of which is proportional to brightness (or intensity) of the data to be provided to the microLED display panel.

Conventional microLED display systems, either adopting or not adopting the PWM scheme, greatly suffer power peak issue due to peak current at the beginning of each horizontal scan period. Furthermore, conventional microLED display systems are also subjected to flicker effect, that is, a visible change in brightness between cycles displayed on the display panel.

A need has thus arisen to propose a novel scheme to improve power peak issue and flicker effect.

SUMMARY OF THE INVENTION

In view of the foregoing, it is an object of the embodiment of the present invention to provide a display system capable of effectively avoiding peak current within each horizontal scan period and substantially reducing flicker, thereby greatly improving power peak issue and flicker effect.

According to one embodiment, a display system includes a display panel and a plurality of drivers. The display panel includes a plurality of micro-light-emitting diodes (microLEDs), and the display panel is divided into a plurality of display blocks. The drivers correspondingly drive the display blocks. Data signals of each driver are provided to a corresponding display block at different times within a horizontal scan period.

According to another embodiment, each driver includes a pulse-width modulation (PWM) device that generates an original PWM signal, a duty cycle of which is proportional to brightness of data to be displayed. The duty cycle of the original PWM signal is divided into a plurality of sub-duty cycles that are spaced from each other, thereby generating a divided PWM signal to be provided to a corresponding display block during the horizontal scan period.

According to a further embodiment, each driver adopts a multiple scan scheme to reduce flicker effect.

and

Figure 5A:
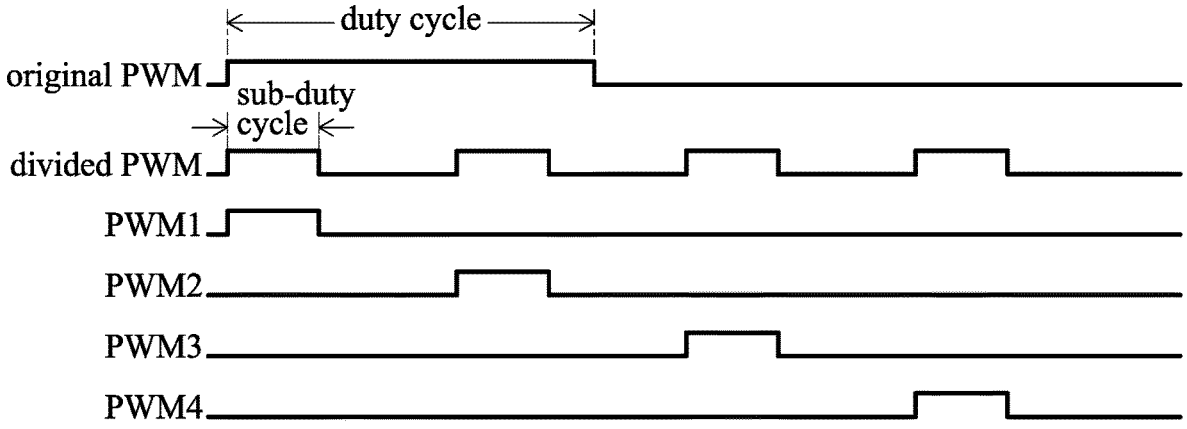
FIG. 5A shows a timing diagram of controlling the display system according to a third embodiment of the present invention.
Figure 5B:
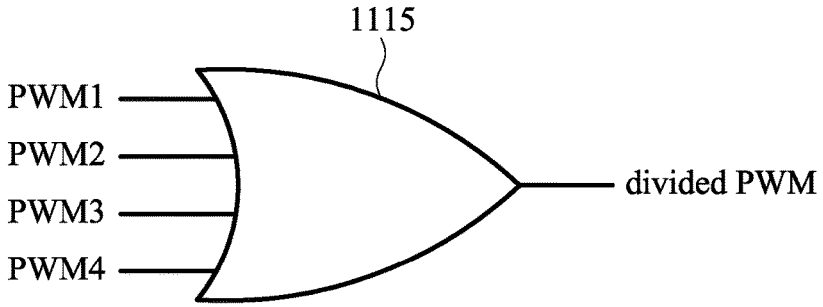

FIG. 5B shows a logic OR gate disposed in the second circuit according to the third embodiment of the present invention.

DETAILED DESCRIPTION OF THE INVENTION

Figure 1:
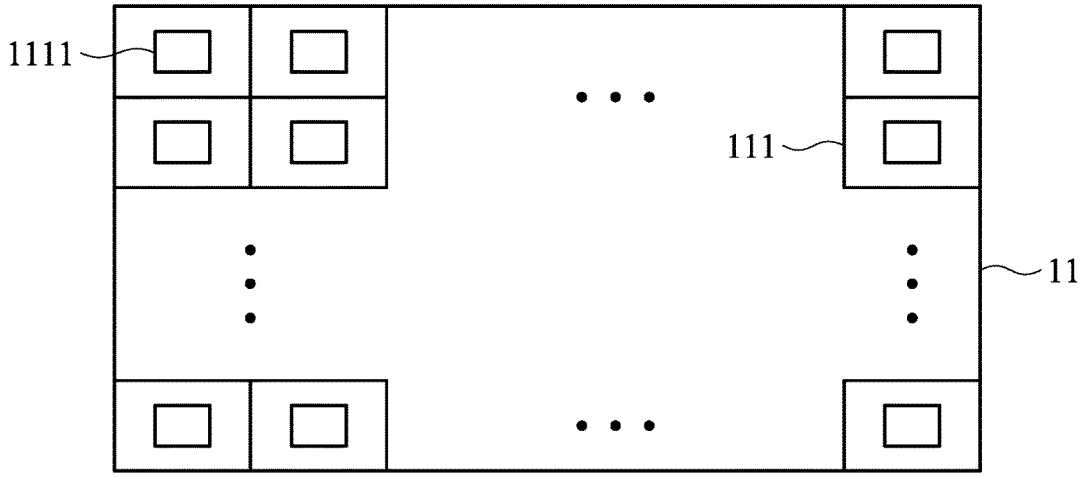
FIG. 1 shows a schematic diagram illustrating a display panel composed of a plurality of display blocks according to one embodiment of the present invention.

FIG. 1 shows a schematic diagram illustrating a display panel 11 divided into a plurality of display blocks 111 arranged in rows and columns (or channels), each display block 111 including a plurality of micro-light-emitting diodes (microLEDs) according to one embodiment of the present invention. Each display block 111 may be individually driven by a corresponding driver 1111. In one example, a display panel 11 (e.g., 17-inch display panel) includes 10×8 display blocks 111, each having resolution of 48×40 RGB. Therefore, overall resolution of the display panel 11 is 480×320 RGB (=(48×10)×(40×8) RGB).

Figure 2:
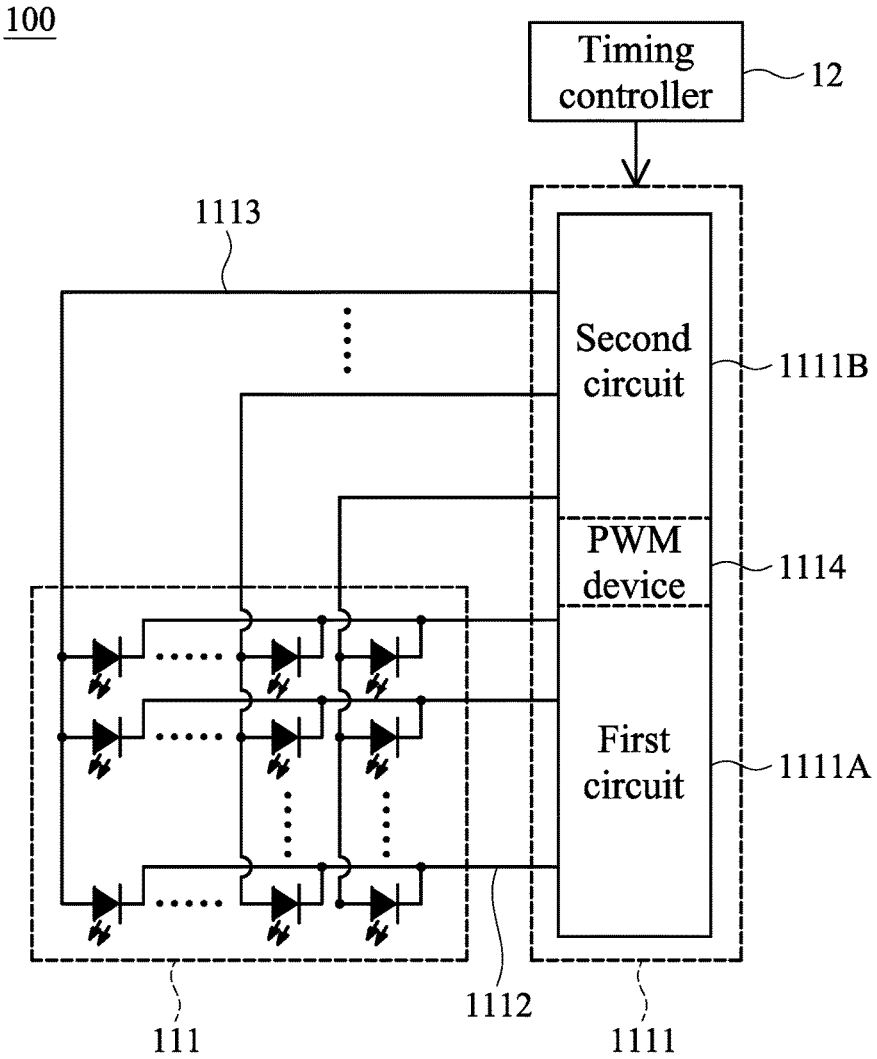
FIG. 2 shows a block diagram illustrating a display system according to one embodiment of the present invention.

FIG. 2 shows a block diagram illustrating a display system 100 according to one embodiment of the present invention. For each display block 111, the driver 1111 of the embodiment may include a first circuit 1111A configured to turn on at least one row of the microLEDs of the display block 111 at a time via scan lines 1112. The driver 1111 may include a second circuit 1111B configured to provide data to microLEDs of the turned-on row of the display block 111 via data lines (or channels) 1113. Specifically, the driver 1111 may include a pulse-width modulation (PWM) device 1114 configured to generate a PWM signal, a duty cycle of which is proportional to brightness (or intensity) of the data (to be provided to the display block 111). In the embodiment, the first circuit 1111A, the second circuit 1111B and the PWM device 1114 are made in a single integrated circuit. The display system 100 may include a timing controller 12 configured to controllably coordinate the drivers 1111 of all the display blocks 111.

Figure 3:
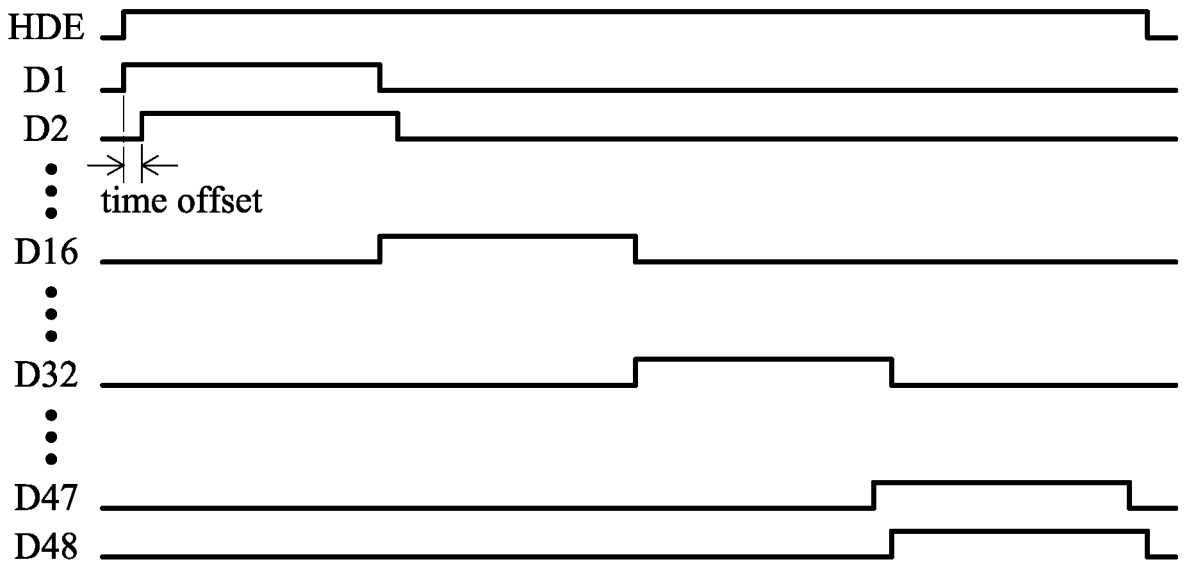
FIG. 3 shows a timing diagram of controlling the display system according to a first embodiment of the present invention.

FIG. 3 shows a timing diagram of controlling the display system 100 according to a first embodiment of the present invention. Specifically, a horizontal scan signal HDE defines a horizontal scan period (i.e., time duration of one scan cycle) for scanning one (turned-on) row of the display block 111. Data signals D1 through D48 respectively represent data to be provided to (the turned-on row of) the display block 111 via the data lines 1113 (48 channels in this example) during the horizontal scan period. It is noted that a duty cycle of the data signal is proportional to brightness of corresponding data. For better understanding the embodiment, the data signals D1-D48 in FIG. 3 are depicted with same duty cycle (i.e., brightness).

According to one aspect of the embodiment, the data signals D1-D48 of different channels are provided (by the second circuit 1111B) to the display block 111 at different times (within the horizontal scan period). Specifically, a data signal of a latter channel of (any) two neighboring channels lags behind a data signal of a former channel of the two neighboring channels with a time offset. In one embodiment, the time offsets for all channels are the same. In an alternative embodiment, at least some time offsets of the channels are different. For example, the time offsets for all channels are randomly set.

Figure 4:
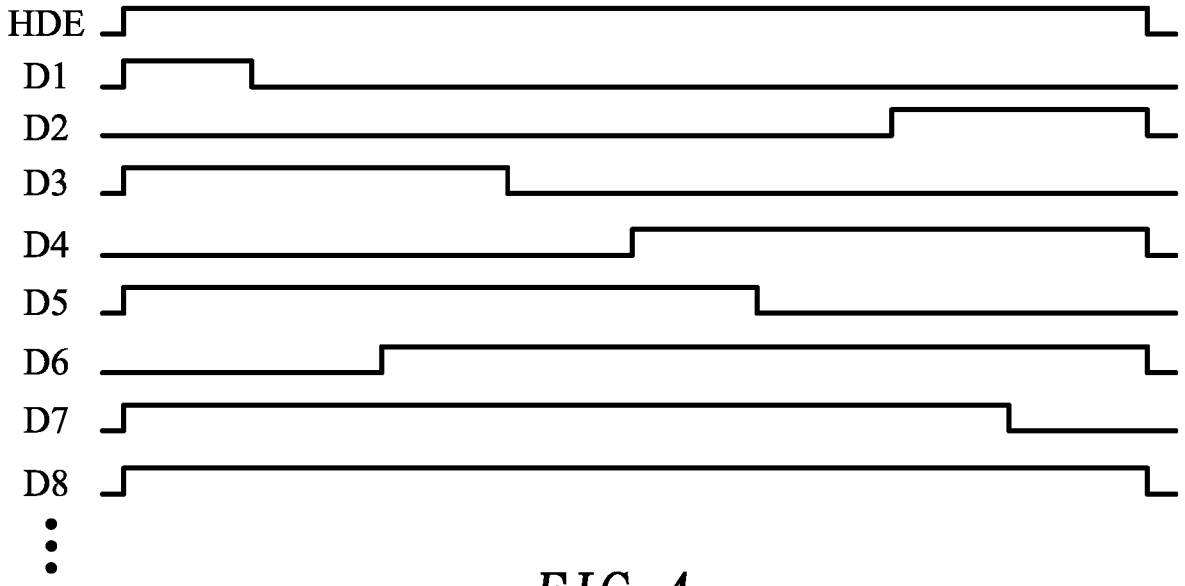
FIG. 4 shows a timing diagram of controlling the display system according to a second embodiment of the present invention.

FIG. 4 shows a timing diagram of controlling the display system 100 according to a second embodiment of the present invention. In this exemplary timing diagram, the data signals D1-D8 in FIG. 4 are depicted with increasing duty cycles (i.e., brightness).

According to one aspect of the embodiment, the data signals of the channels are provided (by the second circuit 1111B) to the display block 111 in reverse in time (within the horizontal scan period). Specifically, a data signal of one channel of (any) two neighboring channels is provided at a beginning of the horizontal scan period, while a data signal of the other channel of the two neighboring channels is provided at an end of the horizontal scan period.

FIG. 5A shows a timing diagram of controlling the display system 100 according to a third embodiment of the present invention. According to one aspect of the embodiment, the duty cycle of the original PWM signal may be divided into a plurality of sub-duty cycles that are spaced from each other, thereby generating a divided PWM signal (to be provided to the display block 111 during the horizontal scan period). As exemplified in FIG. 5A, the divided PWM signal is generated by dividing the duty cycle of the original PWM signal into four sub-duty cycles. In one embodiment, the duty cycle of the original PWM signal is evenly divided. In an alternative embodiment, at least some sub-duty cycles are different in time length.

FIG. 5A further shows some internal PWM signals PWM1-PWM4 of the driver 1111, and FIG. 5B shows a logic OR gate 1115 disposed in the second circuit 1111B according to the third embodiment of the present invention. In the embodiment, the divided PWM signal may be generated by performing logic OR operation on the internal PWM signals PWM1-PWM4.

According to the embodiments as illustrated in FIG. 3 through FIG. 5B, as peak current within each horizontal scan (or synchronization) period can be avoided, power peak issue can be substantially reduced. Moreover, as power consumption is reduced, the driver 1111 can drive a display block 111 with more rows and/or columns. It is appreciated that different schemes as illustrated in FIG. 3 through FIG. 5B may be adapted to different frames temporally. In other words, two neighboring frames may adopt different schemes as described above in a temporal (or time-varying) manner.

According to a fourth embodiment of the present invention, a multiple scan (or multi-scan) scheme may be adopted to reduce flicker effect. For example, the driver 1111 may adopt interlaced scan containing two fields of a video frame captured consecutively. In another example, triple-laced scan containing three fields of a video frame captured consecutively may be adopted instead. In a further example, random scan may be adopted to randomly scan lines of a field of a video frame.

Although specific embodiments have been illustrated and described, it will be appreciated by those skilled in the art that various modifications may be made without departing from the scope of the present invention, which is intended to be limited solely by the appended claims.

What is claimed is:

1. A display system, comprising:

a display panel including a plurality of micro-light-emitting diodes (microLEDs), the display panel being divided into a plurality of display blocks; and a plurality of drivers correspondingly driving the plurality of display blocks;

wherein data signals of each driver are provided to a corresponding display block at different times within a horizontal scan period;

wherein a data signal of a latter channel of two neighboring channels lags behind a data signal of a former channel of the two neighboring channels with a time offset, and time offsets for all channels of the display block are randomly set.

2. The system of claim 1, wherein each driver comprises:

a first circuit that turns on a row of the plurality of microLEDs at a time; and a second circuit that provides data to microLEDs of the turned-on row of the display block.

3. The system of claim 2, wherein the driver comprises:

a pulse-width modulation (PWM) device that generates a PWM signal, a duty cycle of which is proportional to brightness of the data.

4. The system of claim 1, further comprising:

a timing controller that controllably coordinates the plurality of drivers.

5. A display system, comprising:

a display panel including a plurality of micro-light-emitting diodes (microLEDs), the display panel being divided into a plurality of display blocks; and a plurality of drivers correspondingly driving the plurality of display blocks;

wherein data signals of each driver are provided to a corresponding display block at different times within a horizontal scan period;

wherein the data signals of each driver are provided to the corresponding display block in reverse time within the horizontal scan period;

wherein a data signal of one channel of two neighboring channels is provided at a beginning of the horizontal scan period, while a data signal of the other channel of the two neighboring channels is provided at an end of the horizontal scan period.

6. A display system, comprising:

a display panel including a plurality of micro-light-emitting diodes (microLEDs), the display panel being divided into a plurality of display blocks; and a plurality of drivers correspondingly driving the plurality of display blocks, each driver of the plurality of drivers including a pulse-width modulation (PWM) device that generates an original PWM signal, a duty cycle of which is proportional to brightness of data to be displayed;

wherein the duty cycle of the original PWM signal is divided into a plurality of sub-duty cycles that are spaced from each other, thereby generating a divided PWM signal to be provided to a corresponding display block during the horizontal scan period.

7. The system of claim 6, wherein each driver comprises:

a first circuit that turns on a row of the plurality of microLEDs at a time; and a second circuit that provides data to microLEDs of the turned-on row of the display block.

8. The system of claim 6, further comprising:

a timing controller that controllably coordinates the plurality of drivers.

9. The system of claim 6, wherein the duty cycle of the original PWM signal is evenly divided.

10. The system of claim 6, wherein at least some sub-duty cycles are different in time length.

11. The system of claim 6, wherein each driver comprises a logic OR gate that performs logic OR operation on a plurality of internal PWM signals to generate the divided PWM signal.

* * * * *